US010995410B2

(12) United States Patent
Zifferer

(10) Patent No.: US 10,995,410 B2
(45) **Date of Patent: *May 4, 2021**

(54) VISUAL ELECTROLYTIC CORROSION INDICATION AND PREVENTION APPARATUS

(71) Applicant: Packless Industries, Waco, TX (US)

(72) Inventor: Scott Coleman Zifferer, Key Largo, FL (US)

(73) Assignee: Packless Industries, Waco, TX (US)

( * ) Notice: Subject to any disclaimer, the term of this patent is extended or adjusted under 35 U.S.C. 154(b) by 250 days.

This patent is subject to a terminal disclaimer.

(21) Appl. No.: 16/129,003

(22) Filed: Sep. 12, 2018

(65) Prior Publication Data

US 2019/0145011 A1 May 16, 2019

Related U.S. Application Data

(63) Continuation of application No. 15/641,837, filed on Jul. 5, 2017, now Pat. No. 10,221,490.

(51) Int. Cl.
*C23F 13/22* (2006.01)

(52) U.S. Cl.
CPC ..... *C23F 13/22* (2013.01); *C23F 2213/20* (2013.01); *C23F 2213/32* (2013.01)

(58) Field of Classification Search
CPC ..... C23F 13/02; C23F 13/04; C23F 13/06; C23F 13/08; C23F 13/10; C23F 13/16;
(Continued)

(56) References Cited

U.S. PATENT DOCUMENTS 3,621,810 A 11/1971 Zuck
3,794,574 A * 2/1974 Fauth et al. ..... C23F 13/02 204/196.16

(Continued)

OTHER PUBLICATIONS

International Search Report and Written Opinion for PCT/US2018/040955 dated Sep. 13, 2018. pp. 13.

(Continued)

*Primary Examiner* — Alexander W Keeling
(74) *Attorney, Agent, or Firm* — Kowert, Hood, Munyon, Rankin & Goetzel, P.C.; Gareth M. Sampson

(57) ABSTRACT

An apparatus may mount an in-stream, continuous contact, visible, sacrificial anode in a fluid passage for the electrolytic corrosion protection. The apparatus may function to protect heat exchangers and/or other metallically connected system components that share contact with electrolytically active fluids. The apparatus may consist of an in-line anode cartridge including a collar body and a viewing port. The apparatus may include a site glass and compression fittings which seals the device causing corrosive fluids to flow past a sacrificial anode. The apparatus may include a visual indicator and an elastically compressed member (e.g., spring) which facilitate continuous metallic/electrical contact and inspection of the anode through the viewing port without system shut down or disassembly. The elastically compressed member and gauge assembly fills the view-ports with a bright indicator as the anode dissolves and the elastically compressed member expands. The apparatus improves inspection, replacement and effectiveness of sacrificial anodes in electrolytically corrosive environments.

20 Claims, 8 Drawing Sheets

(58) Field of Classification Search
CPC .. C23F 13/22; C23F 2213/20; C23F 2213/30; C23F 2213/32; F24H 9/0047; F16L 58/00–58/188; F17D 5/06
See application file for complete search history.

(56) References Cited

U.S. PATENT DOCUMENTS

| | | | | |
|---|---|---|---|---|
| 3,891,530 | A | 6/1975 | Alewitz | |
| 4,060,472 | A | 11/1977 | Alewitz | |
| 4,171,254 | A | 10/1979 | Koenecke | |
| 4,370,211 | A | 1/1983 | Hybler | |
| 4,377,083 | A | 3/1983 | Shepherd et al. | |
| 4,514,997 | A | 5/1985 | Zifferer | |
| 4,768,495 | A | 9/1988 | Zifferer | |
| 4,846,148 | A | 7/1989 | Zifferer | |
| 5,127,433 | A * | 7/1992 | Argyle | G01N 17/00 116/206 |
| 5,251,693 | A | 10/1993 | Zifferer | |
| 5,311,661 | A | 5/1994 | Zifferer | |
| 5,373,728 | A | 12/1994 | Guentzler | |
| 5,409,057 | A | 4/1995 | Zifferer | |
| 5,563,585 | A | 8/1996 | MacDonald | |
| 5,551,504 | A | 9/1996 | Zifferer | |
| 5,803,128 | A | 9/1998 | Reed | |
| 5,813,438 | A | 9/1998 | Reed | |
| 5,819,807 | A | 10/1998 | Reed | |
| 6,488,079 | B2 | 12/2002 | Zifferer | |
| 6,760,972 | B2 | 7/2004 | Zifferer | |
| 6,903,540 | B2 | 6/2005 | Kean et al. | |
| 6,923,035 | B2 | 8/2005 | Zifferer | |
| 6,932,891 | B2 | 8/2005 | Wigg et al. | |
| 6,968,719 | B2 | 11/2005 | Zifferer | |
| 7,694,402 | B2 | 4/2010 | Zifferer et al. | |
| 7,764,187 | B2 | 7/2010 | Gai et al. | |
| 7,926,160 | B2 | 4/2011 | Zifferer et al. | |
| 8,434,207 | B2 | 5/2013 | Zifferer et al. | |
| 10,221,490 | B2 * | 3/2019 | Zifferer | C23F 13/22 |
| 2004/0222084 | A1 | 11/2004 | Wigg et al. | |
| 2010/0229996 | A1 | 9/2010 | Zifferer et al. | |
| 2014/0069803 | A1 | 3/2014 | McMullen | |
| 2016/0369935 | A1 | 12/2016 | Boehm et al. | |

OTHER PUBLICATIONS

Restriction for U.S. Appl. No. 15/641,837 dated Oct. 27, 2017.
Non Final Office Action for U.S. Appl. No. 15/641,837 dated Feb. 22, 2018.
Notice of Allowance for U.S. Appl. No. 15/641,837 dated Jul. 26, 2018.

* cited by examiner

VISUAL ELECTROLYTIC CORROSION INDICATION AND PREVENTION APPARATUS

PRIORITY CLAIM

This application is a continuation of U.S. patent application Ser. No. 15/641,837 entitled "VISUAL ELECTROLYTIC CORROSION INDICATION AND PREVENTION APPARATUS" filed on Jul. 5, 2017, all of which is incorporated by reference herein.

BACKGROUND OF THE INVENTION

1. Field of the Invention

The present disclosure generally relates to an apparatus which is a combination corrosion inhibitor and corrosion indicator. More particularly, the disclosure generally relates to a corrosion inhibition apparatus including an indicator which notifies when a sacrificial anode requires replacement and facilitates rapid replacement of expiring components.

2. Description of the Relevant Art

In complex systems where sea water or other electrolytically active fluids come in common contact with components of a metal system, electrolytic corrosion can become a root cause of component failure in all metal components including, but not limited to heat exchangers, engines, generators, pumps, piping, and other connected apparatus. The corrosion of any component can result in structural failure, subsequent leakage of system components, and or contamination between the fluids and may cause component and or system failure.

The source of corrosion may be a result of the electrochemical oxidation of metals reacting with an oxidant or fluid. Aqueous corrosion may result from an electrochemical reaction associated with differences in electrical potentials of two different, electrically connected metals which share contact with a common aqueous fluid. The two different metals may be referred to as an active metal and a noble metal. Ions of noble metals are more strongly bound to a surface of the noble metal than the ions of active metals. Given two or more metallic components all connected to each other and an aqueous solution the least noble metal will experience corrosion first. Examples of aqueous media, also referred to generally as electrolytes, may include, but are not limited to, solutions of salt water, acids, bases, or salts, certain gases at high temperatures, molten salts, or combinations thereof.

The corrosion avoidance strategy of supplying a sacrificial, less noble metal is often used to protect the more noble components in a system which interacts with electrolytically active fluids. The strategy only works if there is less noble, non-critical, active metal available to give up its electrons and is in continuous electrical contact with the system requiring protection. Once the sacrificial anode is exhausted the normal system components begin electrolytic corrosion at a comparatively accelerated rate on the next least noble components.

It is common practice to attach an active metal as a sacrificial anode to a more noble metal to reduce or eliminate electrolytic corrosion of a system comprising of numerous metal components. Continuous metallic contact and timely replacement of a depleted sacrificial anode is essential to the effectiveness of the sacrificial anode corrosion reduction strategy. The rate of electrolytic corrosion varies widely based on the conditions of the aqueous solution, proper grounding and the surrounding metallic structures. Failure to properly monitor the corrosion rate of the sacrificial anodes, replacing them prior to exhaustion can result in premature corrosion of the affected components and or system.

A corrosion inhibitor device or apparatus of that would facilitate visual monitoring of the sacrificial anode whether the system is dormant or operational and would allow for easy replacement of the sacrificial anode if visually determined to be necessary and would be beneficial to the sacrificial anode corrosion strategy.

SUMMARY

In some embodiments, a visual electrolytic corrosion indication and prevention apparatus may include provisions for mounting an in-stream, continuous contact, continuously visible sacrificial anode, and visual indicator in a fluid passage. The apparatus may allow for the electrolytic corrosion protection of heat exchangers, engines, generators pumps and other metallically-connected systems components that share contact with electrolytically active fluids. The apparatus may consist of a collar body with a viewing port, collar adapter, system adapter, continuous contact in-line sacrificial anode, visual indicator, containment screen, site glass and compression seals. The compression seals may seal the apparatus components causing corrosive fluids to flow past a sacrificial anode while flowing through and contained by the apparatus. The sacrificial anode may be kept in continuous metallic contact with the apparatus via a spring, and or with hydraulic pressure plate which may be incorporated into the apparatus. The assembled combination of a collar adapter, spring, visual indicator, sacrificial anode, and site glass contained within the body collar when coupled to the base adapter may facilitate continuous visual inspection of the anode through a site glass without system shut down or disassembly. In some embodiments, the spring and visual indicator assembly may insure continuous metallic connection between either collar or system adapters and sacrificial anode which may fill the collar body view-ports with a bright indicator as the anode dissolves and the spring expands moving the coupled visual indicator progressively across the viewport. The apparatus may improve inspection, replacement and effectiveness of sacrificial anodes in electrolytically corrosive environments while facilitating rapid changing of sacrificial anode components without disassembly of flexible hose or rigid piping systems.

In some embodiments, the apparatus includes a collar body with viewports, or is itself transparent, a collar adapter, a system adapter, a sacrificial anode, and a spring coupled visual indicator and may be configured to include a containment screen on the inner diameter of the sacrificial anode. The collar body may include a first end and a second end. The collar adapter may be an internal fit into the collar body and couples, during use, to a first conduit. The collar adapter may be sealed inside the first end of the collar body and may be used alternatively as an inlet side or outlet and the base adapter as the alternate either connecting to the system to be protected. The system adapter may couple during use to a second conduit. The sacrificial anode may be positioned at least partially between the collar adapter and the base adapter. The sacrificial anode may include an opening in fluid flow during use, with the first conduit and the second conduit. The visual indicator may be positioned at least partially between the sacrificial anode and the collar adapter. The visual indicator may provide, a visual gauge regarding the extent of disintegration of the sacrificial anode. Mechanically the visual indicator is coupled to the spring, and may act as a bearing plate separating the spring from the sacrificial anode, evenly applying the spring force against the sacrificial anode, and may if configured may include a flow orifice that applies hydraulic pressure on the sacrificial anode.

In some embodiments, the first conduit and the second conduit are part of a single conduit and/or single assembly.

In some embodiments, the apparatus may include an elastically compressed member positioned between the collar adapter and the visual indicator. The elastically compressed member may apply pressure against the visual indicator that is in direct contact with the sacrificial anode. The elastically compressed member may apply pressure against the visual indicator and the sacrificial anode insuring direct metallic contact with the collar and or system adapter.

In some embodiments, a transparent containment member is positioned inside the collar body in or adjacent to one or more openings in the collar body. In some embodiments, at least a portion of the collar body is transparent or contains a viewport such that as the sacrificial anode dissolves and the spring coupled to the visual indicator expands moving the visual indicator down the axis of flow, progressively blocking the viewport. In some embodiments, the brightly colored visual indicator is visible through the collar body viewports and progressively fills the window as it moves down the axis as the sacrificial anode disintegrates.

In some embodiments, the apparatus may include one or more seals to inhibit fluids from leaking out of the apparatus during use. A first seal may be positioned between the collar adapter and the site glass and a second seal positioned between the site glass and the base adapter. The seals may be enabled by the compressive force exerted on the internal components and seals when the collar body is threaded onto the base adapter.

In some embodiments, the collar adapter is nested within the collar body sharing an axis uncoupled to allow independent rotation around the shared axis or as one part which connects to the system or conduit. In some embodiments, the base adapter is coupled to the collar body via thread or be pressed together and acting to close and seal the apparatus by coupling with the second end of the collar body 110*b*. In some embodiments, the system adapter may be inhibited from moving within the collar body by the site glass and collar adapter and seals contained within which share the same axis of compression within the containment vessel.

In some embodiments, a method of inhibiting corrosion may include conveying a corrosive fluid through a first conduit and through a collar adapter disposed at a first end of a collar body of the apparatus. The method may include conveying the corrosive fluid through an opening of a sacrificial anode and a visual indicator positioned at least partially between the collar adapter and a system adapter disposed at a second end of the collar body. The method may include conveying the corrosive fluid through the system adapter and subsequently through a second conduit coupled to the system adapter. The first conduit and the second conduit may form a part of a system. The method may include an elastically compressed member applying pressure against the visual indicator and the sacrificial anode such that the sacrificial anode remains in direct contact with the apparatus which in turn is connected to the component or system to be protected. The method may include providing a visual indication of the disintegration of the sacrificial anode using the visual indicator as seen through the viewports. The method may include inhibiting corrosion of at least a portion of the system using the visual electrolytic corrosion indication apparatus to replace depleted embodied sacrificial anode in a timely fashion. The method may give an indication of system wide corrosion of non-visual anodes throughout the system, thus helping to indicate the possibility of system anode depletion in addition to component corrosion (e.g., if whole system is grounded). For example in some systems there may be multiple sacrificial anodes in place to protect the system, many of which may not be visible. Using the herein described apparatus may allow one to determine the decomposition of sacrificial anodes which are not visible but installed in the same system (and/or at least a system which is coupled fluidically to the apparatus). One may determine the extent of decomposition of the unseen sacrificial anodes by observing the changing decomposition rate of the sacrificial anode of the apparatus.

In some embodiments, a method of inhibiting corrosion may include the ability to change all internal components of the apparatus by loosening the collar body and sliding it clear of the internal components all of which can then be removed and replaced individually or as an assembly. The method does not require dis-assembly movement or adjustment of either base adapter or collar adapters or the first and second conduits to which they are connected.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
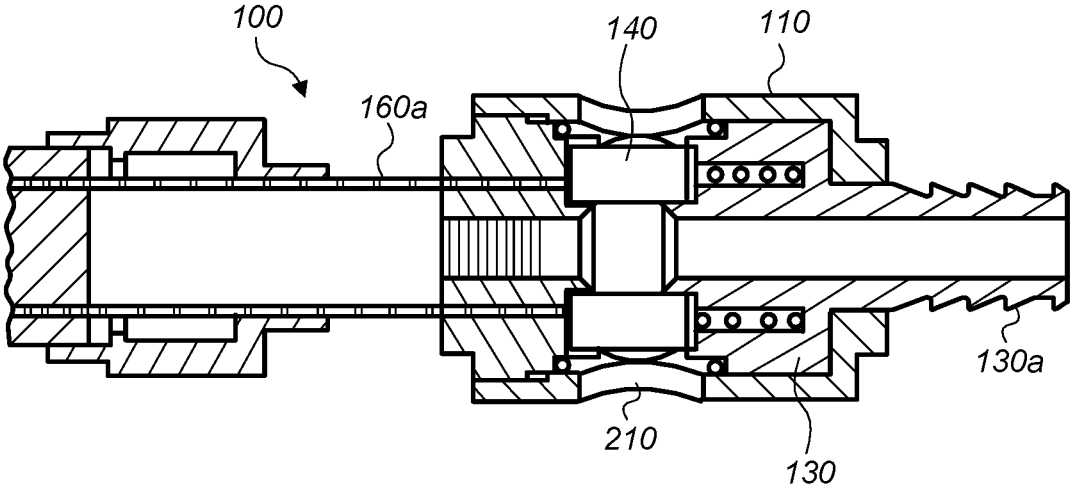
FIG. 1 depicts a diagram of a cross-sectional of a side view of an embodiment of the apparatus coupled to a conduit.
Figure 2:
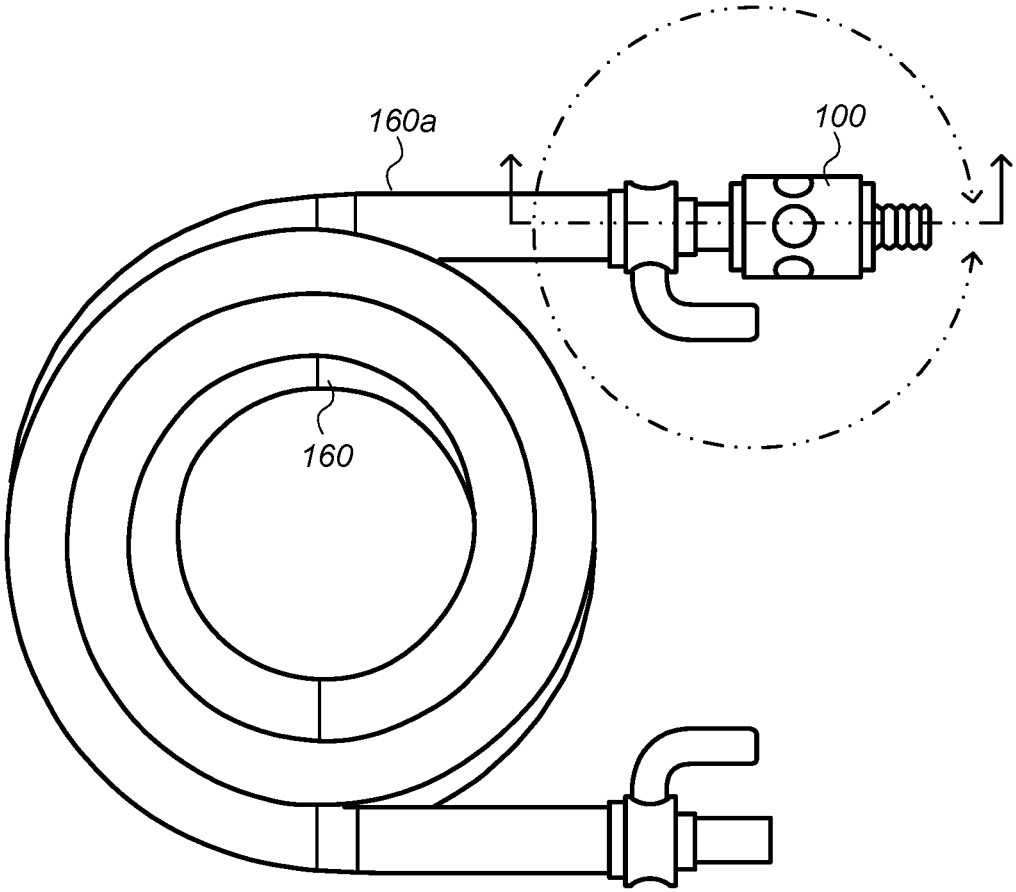
FIG. 2 depicts a diagram of a side view of an embodiment of the apparatus coupled to a conduit.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third die electrically connected to the module substrate" does not preclude scenarios in which a "fourth die electrically connected to the module substrate" is connected prior to the third die, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or particular fluid systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "direct" or "directly" as used herein generally refers to one structure in physical contact with another structure, or, when used in reference to a procedure, means that one process effects another process or structure without the involvement of an intermediate step or component.

The term "noble metal" as used herein generally refers to a metal that resists chemical action, does not corrode, and is not easily attacked by acids or is the most noble in a collection of connected dissimilar metals.

The term "sacrificial anode" as used herein generally refers to a galvanic anode and is typically part of a galvanic cathodic protection (CP) system used to protect metal structures from corrosion. Sacrificial anodes are made from a metal alloy with a more "active" voltage (more negative reduction potential more positive electrochemical potential) than the metal of the structure. The difference in potential between the two metals means that the galvanic anode corrodes, so that the anode material is consumed in preference to the structure.

The term "elastically compressed" as used herein generally refers to a material such as a spring that stores energy in the form of elastic deformation which exerts pressure on the structures compressing its size. The pressure applied by the elastically compressed member will act to insure positive contact directly between the sacrificial anode and the adapters.

The term "site glass" as used herein generally refers to a portion of some embodiments of an apparatus described herein. At least portions of the site glass may be transparent. The site glass may be formed from any transparent material including glass or plastics.

Figure 15:
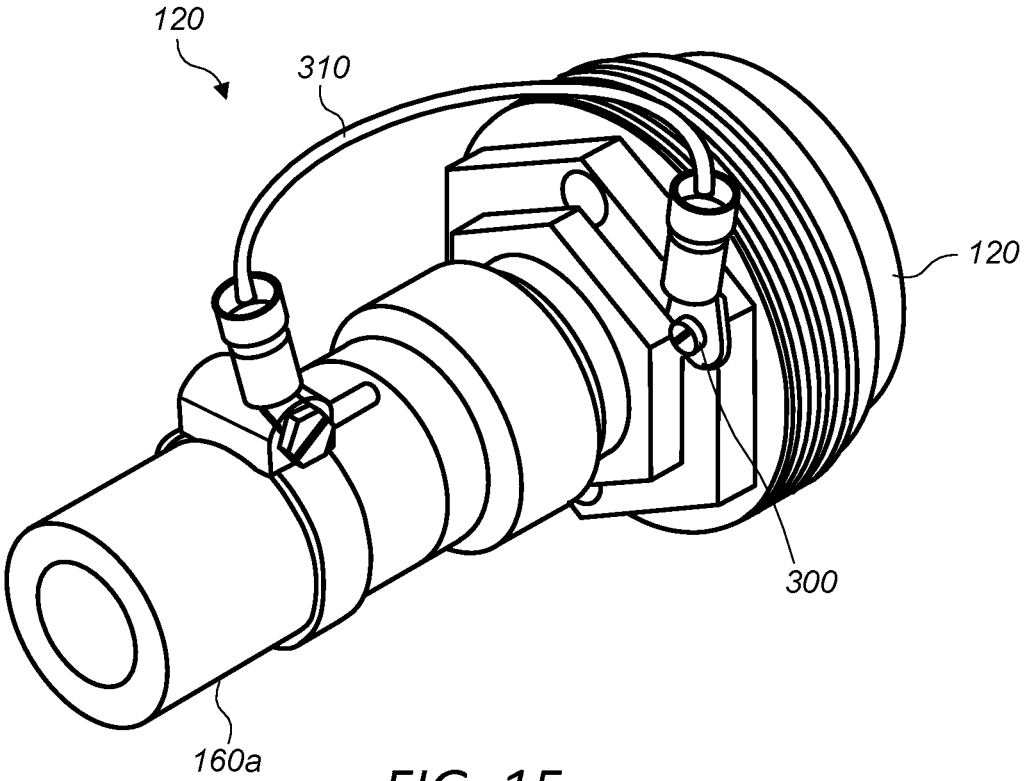
FIG. 15 depicts a diagram of a perspective view of an embodiment of a system adapter coupled to a conduit via a ground wire.
Figure 16:
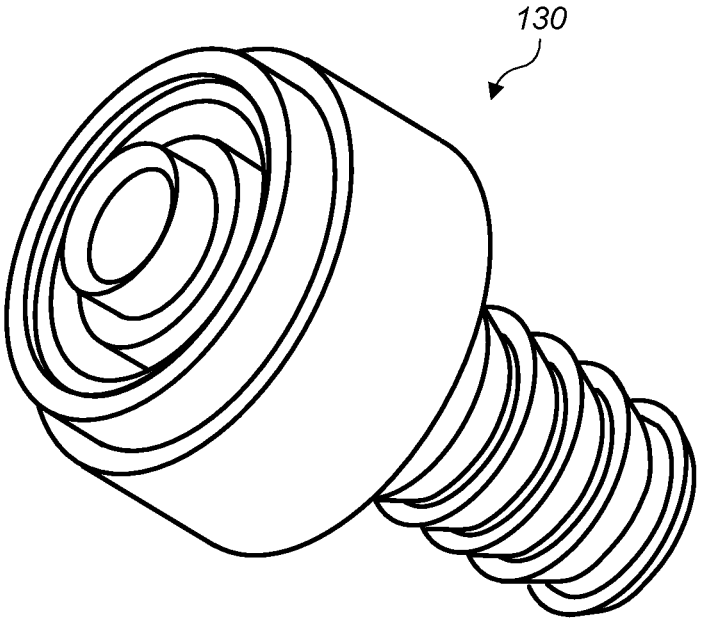
FIG. 16 depicts a diagram of a perspective view of an embodiment of a system adapter and variants of connectability.

In some embodiments, the apparatus 100 includes a collar body 110, a collar adapter 120, a sacrificial anode 140, an anode indicator 150, an elastically compressed member 170, and a system adapter 130. FIGS. 1-4 depict diagrams of a cross-sectional, exploded, and perspective views of an embodiment of the apparatus 100 coupled to a conduit 160. The collar body may include a first end 110*a* and a second end 110*b*. The collar adapter may couples, during use, to a first conduit 160*a*. The collar adapter may be nested inside at the first end 110*a* of the collar body and the system adapter at the second end 110*b*. The system adapter may couple during use to a second conduit 160*b* (e.g., as depicted in FIG. 15). The sacrificial anode 140 may be positioned at least partially between the collar adapter 120 and the system adapter 130.

Figure 3:
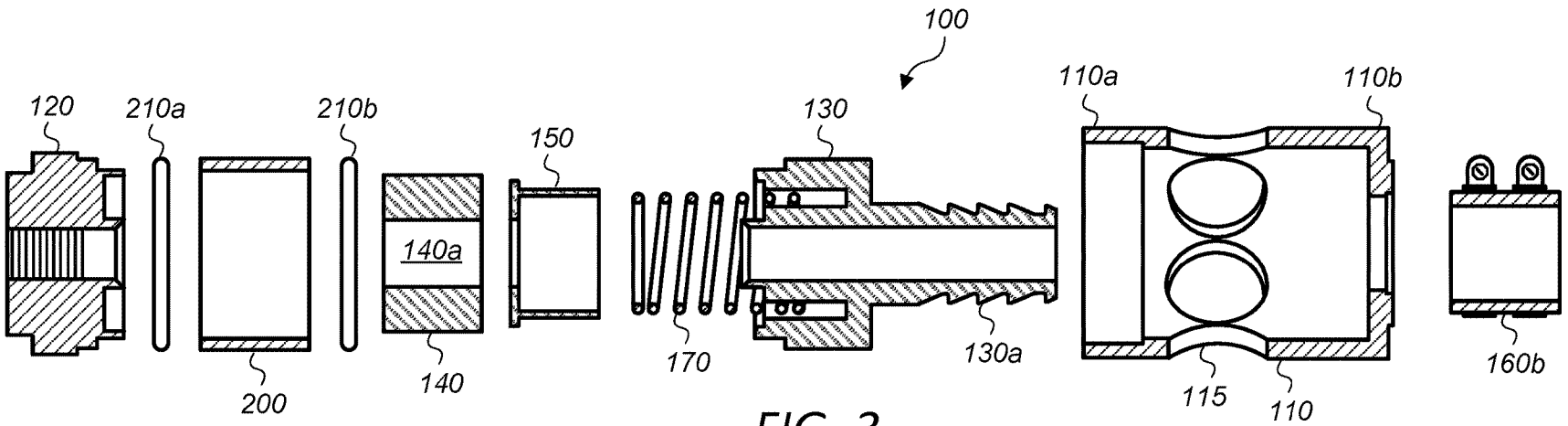
FIG. 3 depicts a diagram of a cross-sectional of an expanded side view of an embodiment of the apparatus.

In some embodiments, the sacrificial anode 140 and the visual indicator 150 may include opening 140*a* and opening 150*a* (e.g., as depicted in FIG. 3) in fluid communication, during use, with the first conduit and the second conduit. The visual indicator 150 is coupled to the elastically compressed member 170 and may be positioned at least partially between the sacrificial anode and the system adapter. The brightly colored visual indicator may provide, during use, a visual indicator regarding an extent of a dissolution of the sacrificial anode as the spring expands.

Many current sacrificial anodes are designed and/or implemented in such a way as to protrude into a flow of a fluid flow resulting in a drop in pressure of a flow stream. In some embodiments, the sacrificial anode may include an opening extending through the collar body of the sacrificial anode. The opening allows a corrosive fluid to flow through the sacrificial anode and the apparatus. In some embodiments, the opening of the sacrificial anode may be dimensioned such that the sacrificial anode does not cause a drop in pressure of a flow stream of the corrosive fluid. For example, the sacrificial anode may be dimensioned such that the sacrificial anode does not protrude into the flow of the fluid flow stream but rather lines the circumference of the flow path. The nature of the exposure of the anode on the walls of the tube may reduce abrasive removal of anode material while maximizing the surface area exposed to the fluid stream.

Figure 5:
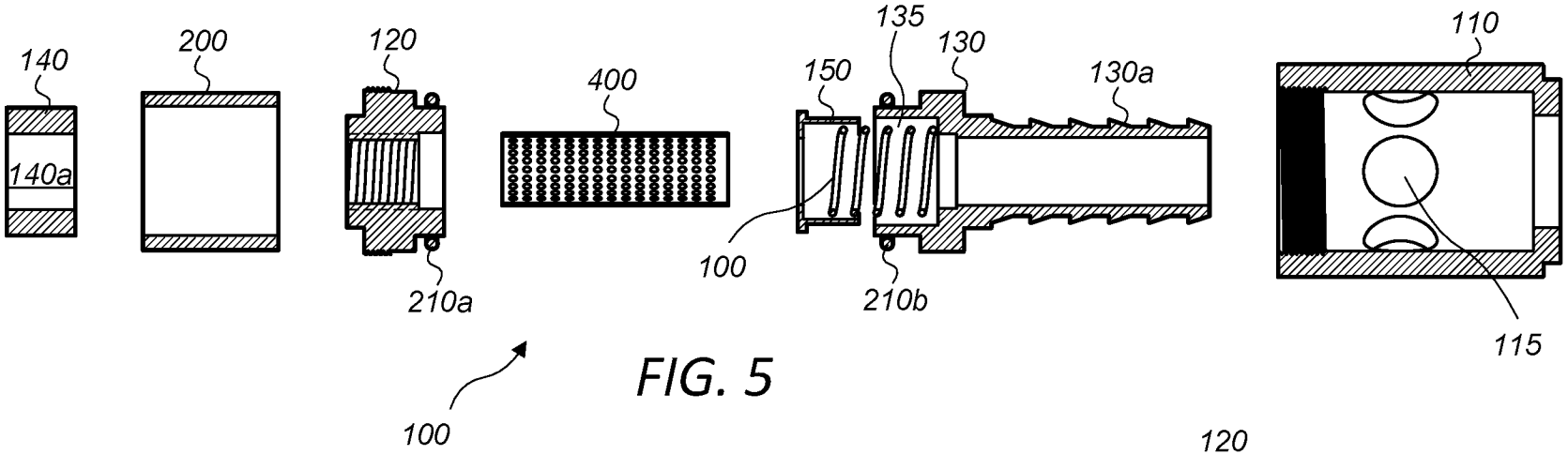
FIG. 5 depicts a diagram of a cross-sectional of an expanded side view of an embodiment of the apparatus including a containment screen.
Figure 6:
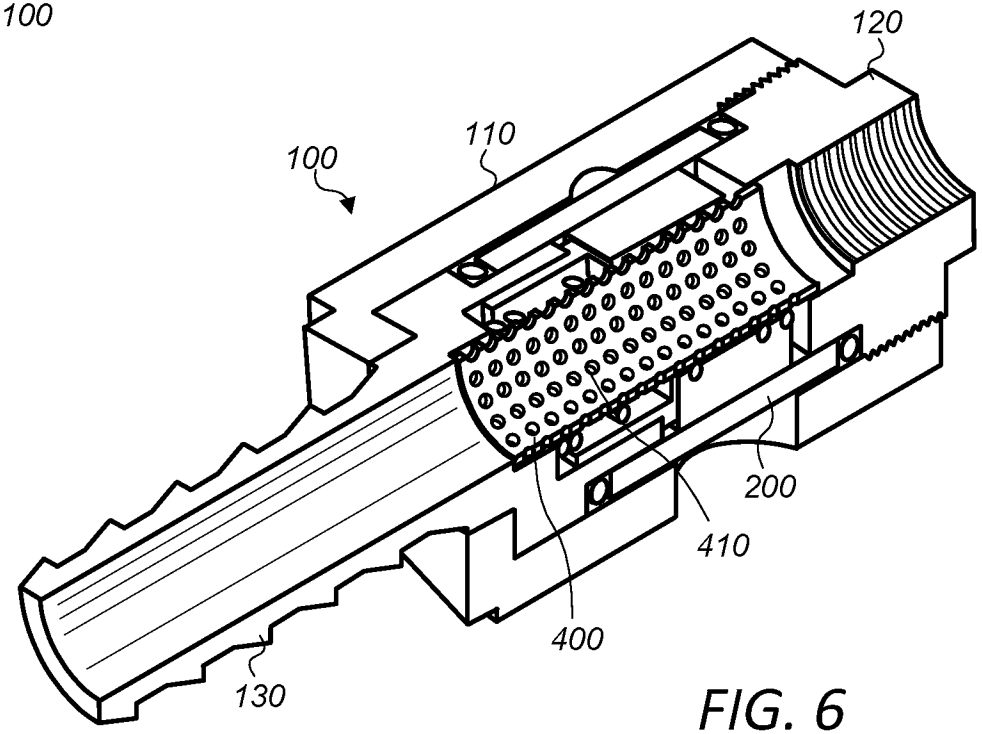
FIG. 6 depicts a diagram of a cross-sectional of a side view of an embodiment of the apparatus including a containment screen.

In some embodiments, the anode may be protected by a containment screen 400. FIGS. 5-6 depict diagrams of a cross-sectional of a side view of an embodiment of the apparatus 100 including a containment screen 400. The containment screen may be positioned along at least an inner diameter of the sacrificial anode. Generally the containment screen may inhibit portions of the sacrificial anode from entering the flow of the fluid stream during use while still allowing the fluid to interact with the sacrificial anode. As the sacrificial anode reacts with the fluid flowing through the apparatus portions of the sacrificial anode may flake or break off of the main body of the sacrificial anode. These break away portions may (absent a containment screen) may enter the fluid flow and subsequently the system to which the apparatus is connected to. Portions of the sacrificial anode moving through the system may damage the system leading to extra unnecessary maintenance.

In some embodiments, the containment screen may reduce or inhibit the resulting uneven surface of the sacrificial anode from disturbing the flow of the fluids as the sacrificial anode dissolves during use. The containment screen may inhibit the pressure from the flow of the fluid from prematurely dissolving the sacrificial anode, effectively holding the sacrificial anode in position as the anode.

In some embodiments, the containment screen may be formed from a material which is chemically inert or at least resistant to the environment the screen is exposed (e.g., the fluids flowing through the apparatus). The containment screen may be formed from, for example, stainless steel or certain plastics. The containment screen may be in the shape of a hollow tube or conduit which has a similar diameter to the opening extending through the apparatus. The containment screen may include a number of openings 410 or perforations extending through the screen to allow the fluids access to the sacrificial anode. The containment screen (e.g., along with the elastically compressed member, visual indicator, and/or sacrificial anode) may be such that they are easily removable and replaced as needed (i.e., typically when the sacrificial anode is replaced after having mostly or totally dissolved).

In some embodiments, a sacrificial anode may be formed from a more active metal or a less noble metal relative to any metal parts of a system which are desired to be protected. The sacrificial anode may be formed from, for example, magnesium, aluminum, and/or zinc. Magnesium has the most negative electro-potential of the three and is more suitable for areas where the electrolyte (soil or water) resistivity is higher. In some cases, the negative potential of magnesium can be a disadvantage: if the potential of the protected metal becomes too negative, hydrogen ions may be evolved on the cathode surface leading to hydrogen embrittlement or to disbonding of the coating. Zinc and aluminum are generally used in salt water, where the resistivity is generally lower. Zinc is considered a reliable material, but is not suitable for use at higher temperatures, as it tends to becomes less negative; if this happens, current may cease to flow and the anode stops working. Zinc has a relatively low driving voltage, which means in higher-resistivity soils or water it may not be able to provide sufficient current. However, in some circumstances (e.g., where there is a risk of hydrogen embrittlement) this lower voltage is advantageous, as overprotection is avoided. Aluminum anodes have several advantages, such as a lighter weight, and much higher capacity than zinc. However, aluminum's electrochemical behavior is not considered as reliable as zinc, and greater care must be taken in how aluminum anodes are used. Since the operation of a galvanic anode relies on the difference in electropotential between the anode and the cathode, practically any metal can be used to protect some other, providing there is a sufficient difference in potential. For example, iron anodes can be used to protect copper.

Figure 7:
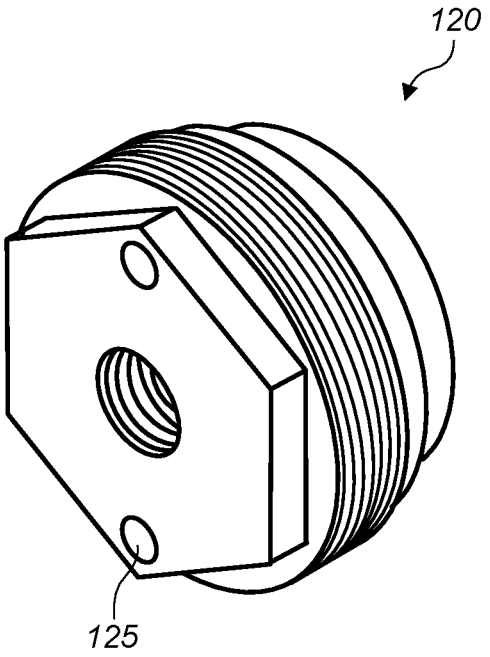
FIG. 7 depicts a diagram of a perspective view of an embodiment of a collar adapter of the apparatus.
Figure 8:
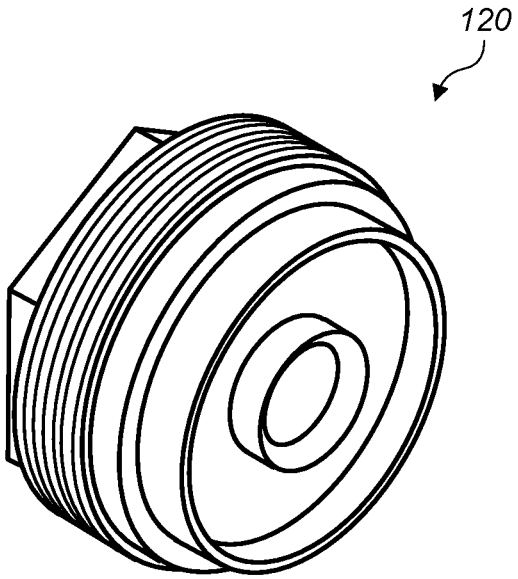
FIG. 8 depicts a diagram of a perspective view of an embodiment of a collar adapter of the apparatus.

In some embodiments, the collar body may act as structural coupler and a containment vessel of the apparatus (e.g., as depicted in FIGS. 1-4). The collar body may be fitted over the collar adapter and sacrificial anode. FIGS. 7-8 depict a diagram of a perspective view of an embodiment of a collar adapter 120 of the apparatus 100. The collar adapter 120 may be nested within the collar body 110 such that the sacrificial anode 140, elastically compressed member 170, visual indicator 150, site glass 200 remain within the collar body. The collar adapter may include threading (e.g., external threading as depicted in FIGS. 7-8) which is complementary to the threading (e.g., internal threading) at a first end of the collar body end 110*a*. The threading may put all elements contained between the adapters into a state of compression which may provide the force to compress and enable the seals and contains the fluid within the apparatus.

In some embodiments, the collar adapter 120 (or system adapter 130) may include features which facilitate assembly/disassembly of the corrosion inhibition apparatus. For example, the collar body or either adapter may include one or more openings 125 which allow, for example, a spanner wrench to engage the adapters and or body collar body to gain leverage to remove the collar body. The collar body and either adapter may include one or more faces 127 which allow for a tool (e.g., a wrench) to engage the adapters such that a user may gain more leverage to facilitate disassembly of the apparatus.

Threading or other similar coupling means may allow rapid changing of sacrificial anode without disconnecting a conduit or other fixed plumbing from the system. This simple screw mechanism effectively seals the fluid while minimizing the disruption of hose or piping connections and plumbing. This configuration allows the apparatus to be disassembled without disconnecting the inlet or outlet conduits, by unscrewing the collar body from the collar adapter. This method prevents the necessity of disassembling the first or second conduit whether fixed or flexible and makes replacement of the sacrificial anode, spring, visual indicator and site glass without disconnecting the apparatus from either conduit.

In some embodiments, the sacrificial anode may be positioned in the collar body of the apparatus. The sacrificial anode may be positioned adjacent to the collar adapter such that the sacrificial anode is in direct and constant contact with the collar adapter. It is important to ensure continuous direct metallic contact between the sacrificial anode and the apparatus and that either or both adapters are metallically connected to the device to be protected.

Figure 9:
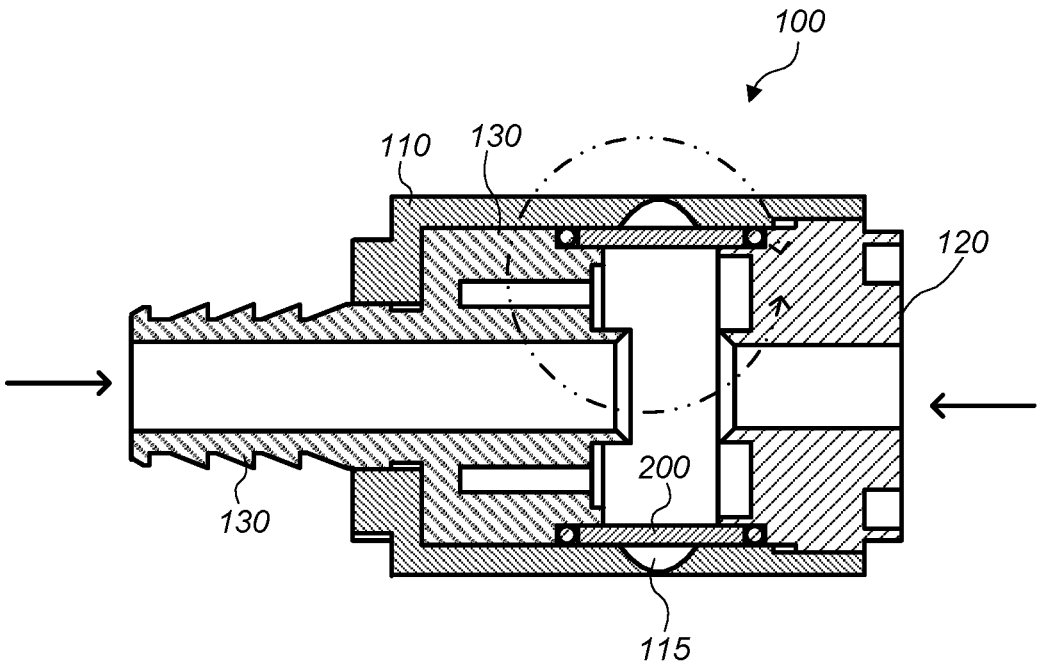
FIG. 9 depicts a diagram of a cross-sectional of a side view of an embodiment of the apparatus.
Figure 10:
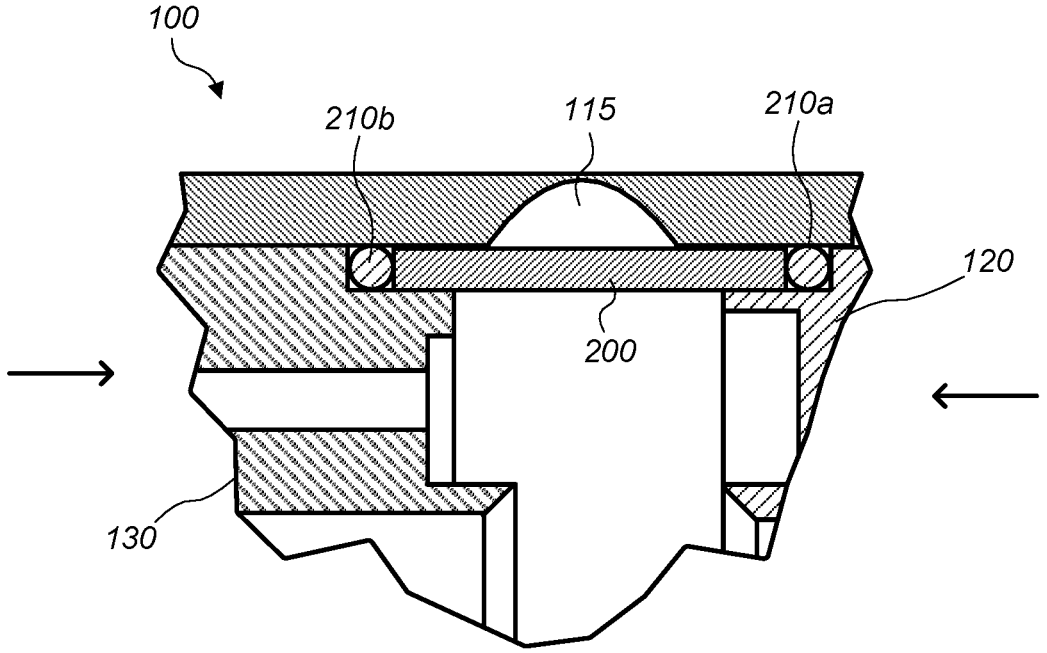
FIG. 10 depicts a diagram of an expanded view of a portion of FIG. 9 of a cross-sectional of a side view of an embodiment of the apparatus, with a viewport to an anode cartridge and Anode Indicator.

In some embodiments, the apparatus may include a site glass 200. FIGS. 9-10 depict a diagram of a cross-sectional of a side view of an embodiment of the apparatus 100 highlighting the site glass 200. The site glass may be similar to form and function of a plastic or glass tube lining the collar body of the apparatus. The site glass may be positioned on the inner diameter of the collar body between the collar adapter 120 and the system adapter 130. The site glass may be positioned such that it is internal to one or more viewports 115 in the collar body 110. The site glass may contain the liquid within the inside diameter of the site glass and while facilitating the viewing of the sacrificial anode and or the visual indicator internal to the apparatus through the viewports during use. The site glass may allow a user to visually verify a state of the sacrificial anode and/or hence the amount of corrosion associated with the system. The site glass material may differ to be suitable for the corrosive nature of the electrolytically active fluids. The site glass may be structurally substantial enough to withstand the compressive sealing force of the threaded coupling and operating pressure and temperature of the fluid. The site glass may be reinforced by the collar body on the outside diameter of the site glass. In some embodiments, the site glass may be formed from glass, plastics or other transparent material.

In some embodiments, a first seal 210*a* (e.g., an o-ring) may be positioned between the collar adapter 120 and the site glass 200. In some embodiments, a second seal 210*b* (e.g., an o-ring) is positioned between the site glass 200 and the system adapter 130. The collar body of the device may apply force along the axis of fluid flow forcing the respective collar adapter and system adapter inward towards the site glass and first and/or second seals positioned between the adapters and the site glass (e.g., as depicted in FIG. 10). The respective adapters are separated from the site glass by the seals 210 (e.g., formed from rubber or metal) which are all being compressed together as the collar body is threaded into the base adapter. The seal that forms between the site glass and sealing surface on each adapter is sealed by the first and second seals. The seals are compressed as the collar body is threaded onto the collar adapter resulting in the seal(s) deforming to form a seal between the site glass 200 and the adapters 120 and 130.

Figure 11:
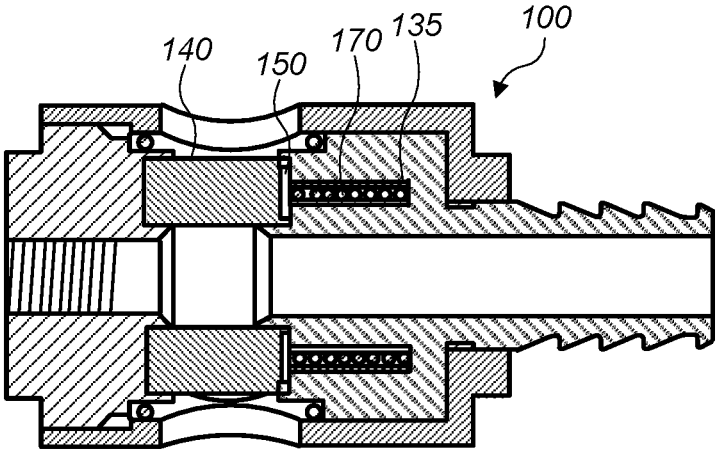
FIG. 11 depicts a diagram of a cross-sectional of a side view of an embodiment of the apparatus with a sacrificial anode.
Figure 13:
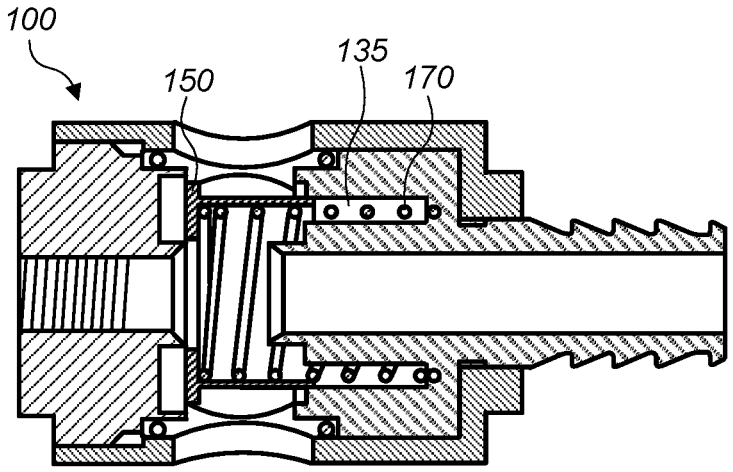
FIG. 13 depicts a diagram of a cross-sectional of a side view of an embodiment of the apparatus without a sacrificial anode.
Figure 14:
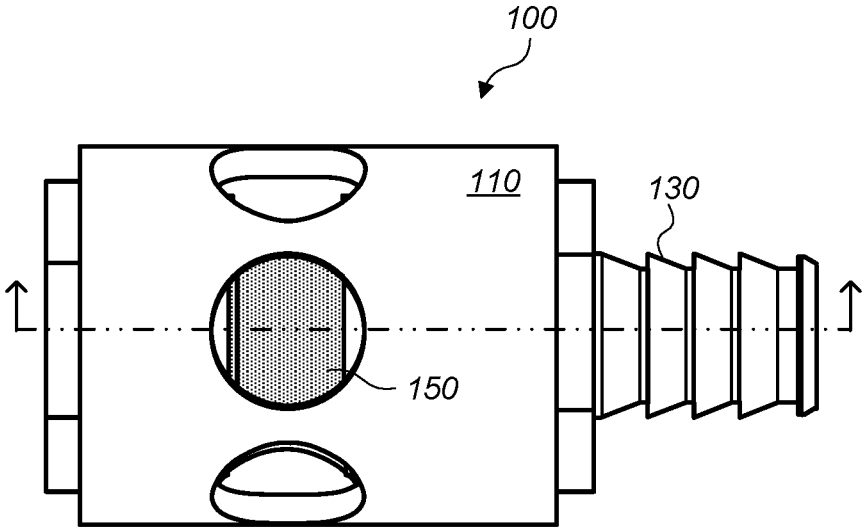
FIG. 14 depicts a diagram of a side view of an embodiment of the apparatus without a sacrificial anode.

In some embodiments, the apparatus 100 may include a visual indicator 150. The visual indicator 150 may be positioned in the collar body 110 of the apparatus 100 between the sacrificial anode 140 and the system adapter 130 (e.g., as depicted in FIGS. 11, 13-14). The visual indicator may be colored or may be fluorescent to increase the visibility of the indicator relative to the apparatus and specifically relative to the sacrificial anode. In some embodiments, at least a portion of the visual indicator may fit within a channel. At least a portion and/or all of the indicator may fit within the channel inside the site glass. During use the visual indicator coupled to the elastically compressed member may apply pressure to the sacrificial anode such that the sacrificial anode remains in direct contact with the collar adapter.

In some embodiments, the apparatus may include a collar adapter and system adapter. The collar adapter may be disposed at the first end 110*a* of the collar body 110. The system adapter may be coupled to or adjacent the second end 110*b* of the collar body. In some embodiments, most of the collar adapter may be nested inside the collar body at the first end of the collar body. In some embodiments, the system adapter may be formed as a part of the second end of the collar body of the apparatus. In some embodiments, a portion of the either adapter may extend out of the collar body with outer diameter and depth to allow numerous forms of connection including but not limited to, NPT internal and external, crimped, welded or brazed or barbed (as depicted) for hose and clamps.

Figure 12:
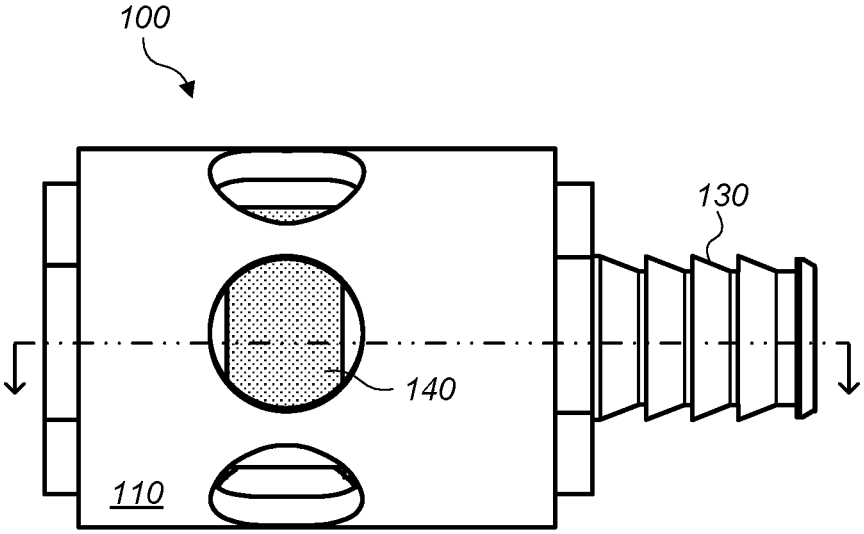
FIG. 12 depicts a diagram of a side view of an embodiment of the apparatus with a sacrificial anode.

In some embodiments, the apparatus may include a elastically compressed member 170 (e.g., as depicted in FIGS. 3, 11, 14). The elastically compressed member 170 may be positioned between the system adapter 130 and the visual indicator 150. The elastically compressed member may apply pressure against the visual indicator 150 and the sacrificial anode 140. The elastically compressed member may apply pressure against the visual indicator 150 and the sacrificial anode 140 such that the sacrificial anode makes physical contact with the collar adapter 120 (even as the sacrificial anode dissolves and diminishes in size). In some embodiments, at least a portion of the elastically compressed member may fit within a channel 135 inside the system adapter 130 and or site glass 200 during use. At least a portion and/or all of the elastically compressed member 170 may fit within the channel in order to allow for space for the sacrificial anode while maintaining as compact a design as possible. The elastically compressed member may include a spring. FIGS. 11-12 depict a diagram of a cross-sectional of a side view and a simple side view respectively of an embodiment of the apparatus 100 with a sacrificial anode 140 visible through the collar body 110 and the elastically compressed member 170 contracted due to the sacrificial anode.

In some embodiments, the sacrificial anode 140 may be kept in continuous metallic contact with the noble metal collar adapter 120 of the apparatus 100 by the internal elastically compressed member 170. The elastically compressed member may provide a continuous force on the sacrificial anode acting to maintain direct contact against the collar adapter for continuous positive electric conductivity as the sacrificial anode dissolves and reduces in size. The system adapter may include or be adjacent to a channel 135 which houses the elastically compressed member 170 and visual indicator 150 when the sacrificial anode 140 is compressed against the collar adapter.

In some embodiments, the fluid pressure exerted on the assembly or sacrificial anode 140 which may be configured to contain a restrictive orifice that facilitates hydraulic pressure on the visual indicator 150 and/or the sacrificial anode 140 when the fluid is flowing. The hydraulic force realized may act in combination with the elastically compressed member 170 to ensure continuous electrical contact between the sacrificial anode 140 and the collar adapter 120.

In some embodiments, during use as the sacrificial anode 140 disintegrates, the elastically compressed member 170 expands maintaining force on the sacrificial anode insuring direct contact with the collar adapter 120. The expansion of the elastically compressed member 170 extends along the axis of the site glass 200 and causes a brightly colored indicator 150 connected to the elastically compressed member 170 to progressively fill the view-ports 115 as the sacrificial anode 140 dissolves and the spring expands. FIGS. 13-14 depict a diagram of a cross-sectional of a side view and a simple side view respectively of an embodiment of the apparatus 100 without a sacrificial anode 140 with the indicator 150 visible through the viewports 115 and the elastically compressed member 170 expanded. The visual indicator which represents the level of sacrificial anode corrosion, which may present a brightly colored visual indicator that greatly simplifies inspection of the sacrificial anode, without any disassembly of the device.

This device described herein provides a continuously visible sacrificial anode that can be inspected while running, without a system interruption or component disassembly. The sacrificial anode is directly visual through the viewports that are incorporated into or as a part of the collar body. The timely replacement of exhausted sacrificial anodes is critical to minimizing the electrolytic corrosion. Viewports in the collar body or transparency of the collar itself, allows for the visibility of the sacrificial anode and/or the visual indicator reaffirms that all components are still being protected from electrolytic corrosion by the sacrificial anode. The device described herein eliminates the time and effort needed to periodically disassemble anode holders for inspection, avoiding hose or piping disassembly for anode inspection, and/or other more cumbersome mechanical methodologies. The visual nature of the device greatly enhances the ease of maintaining the sacrificial anode strategy on components and or systems.

In some embodiments, the collar adapter and the system adapter may be attached to the fluid input or output of the system requiring electrolytic corrosion protection. The apparatus may be attached by any method so long as the anode maintains direct metallic contact with the apparatus. In some embodiments, direct metal contact may be provided by a bonding wire contact 300 from the apparatus to the system requiring protection. Either or both adapters may have a threaded hole (e.g., as depicted in FIG. 15) that allows the apparatus to be positively connected to the system by means of a ground wire 310 assuring the flow of electrons from the invention to the system to be protected.

Figure 4:
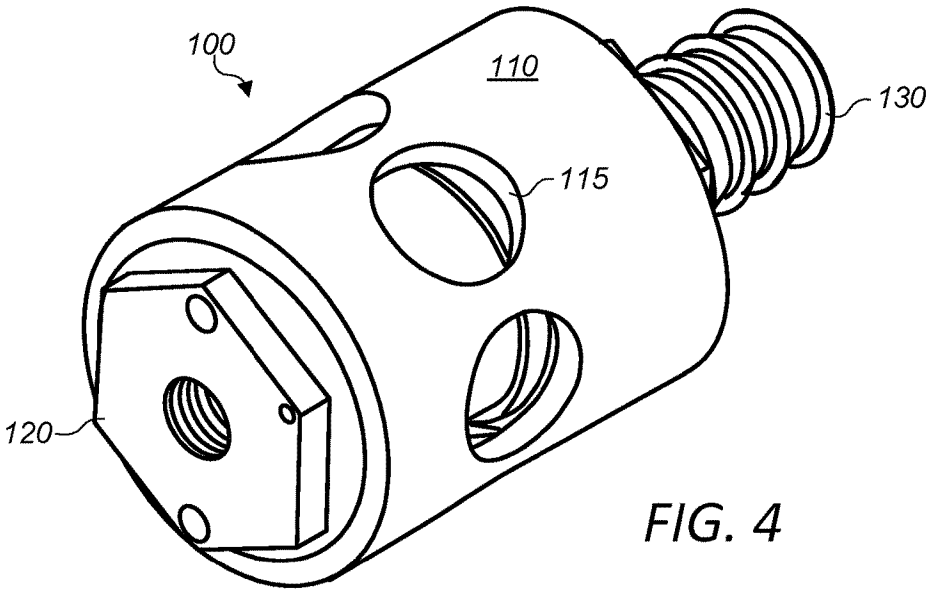
FIG. 4 depicts a diagram of a perspective view of an embodiment of the apparatus.

In some embodiments, the collar adapter or system adapter may include numerous methods of attaching the apparatus 100 to the heat exchanger or system requiring electrolytic corrosion protection. Methods of attaching may include, but are not limited to, brazing, welding, male or female threading (e.g., as depicted in FIGS. 4 and 6) commercial plumbing connectors, unions, crimpable connectors, NPT fittings and most if not all conventional methods of plumbing attachments for inline devices. The methods of attachment may all allow retro-active fitting of the apparatus into previously installed legacy systems requiring electrolytic corrosion protection.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An apparatus for corrosion inhibition and corrosion indication, comprising:

a collar body comprising a first end and a second end positioned opposite to the first end, wherein the first end and the second end couple, during use, to a first conduit and a second conduit respectively;

a sacrificial anode positioned at least partially within the collar body, wherein the sacrificial anode comprises an opening in fluid communication, during use, with the first conduit and the second conduit, wherein the opening comprises a diameter such that the opening does not protrude into a fluid flow during use relative to other components of the apparatus; and a visual indicator positioned at least partially between the sacrificial anode and an end of the collar body, wherein the visual indicator provides, during use, a visual signal regarding an extent of a dissolution of the sacrificial anode.

2. The apparatus of claim 1, wherein the first conduit and the second conduit are part of a single conduit coupled to a system of at least one component.

3. The apparatus of claim 1, further comprising a containment screen positioned along a surface of the sacrificial anode forming the opening through the sacrificial anode, wherein the containment screen comprises a plurality of openings allowing fluids flowing through the apparatus to contact the sacrificial anode.

4. The apparatus of claim 1, further comprising an elastically compressed member positioned at least partially between an end of the collar body and the visual indicator, wherein the elastically compressed member applies pressure against the visual indicator and the sacrificial anode.

5. The apparatus of claim 4, wherein the elastically compressed member applies pressure against the visual indicator and the sacrificial anode such that the sacrificial anode remains in contact with at least a portion of the corrosion inhibition apparatus insuring metallic contact with the system.

6. The apparatus of claim 1, further comprising an elastically compressed member that when compressed acts to seal all apparatus components containing the electrolytic fluid internal to all apparatus components being held in compression by threads or other means.

7. The apparatus of claim 1, wherein the visual indicator is visible through the collar body as the sacrificial anode dissolves.

8. The apparatus of claim 1, wherein at least a portion of the apparatus is transparent such that as the sacrificial anode dissolves more of the visual indicator becomes visible.

9. The apparatus of claim 8, further comprising a site glass positioned in the collar body in or adjacent to one or more openings in the collar body.

10. The apparatus of claim 1, further comprising one or more seals to inhibit fluids from leaking out of the collar body of the apparatus during use.

11. The apparatus of claim 1, further comprising:

a collar adapter disposed at the first end of the collar body, wherein the collar adapter couples, during use, to a first conduit;

a system adapter disposed at the second end of the collar body, wherein the system adapter couples during use to a second conduit.

12. The apparatus of claim 11, further comprising a site glass positioned in the collar body in or adjacent to one or more openings in the collar body; and a first seal positioned between the collar adapter and the site glass and a second seal positioned between the site glass and the system adapter.

13. The apparatus of claim 11, wherein the collar adapter is contained within or a part of the collar body.

14. The apparatus of claim 11, wherein at least a portion of the system adapter is positioned in the collar body.

15. The apparatus of claim 11, wherein the system adapter is inhibited from moving within the collar body along a longitudinal axis of the collar body by the collar adapter coupling to the collar body.

16. The apparatus of claim 11, wherein the collar body which shares a common axis with the collar adapter and system adapter and which rotates around the axis independently from the collar and or system adapter, allowing disassembly of apparatus without disconnecting from either the collar adapter or the system adapter from the first or second conduit.

17. A method of inhibiting corrosion, comprising:

conveying a corrosive fluid through a first conduit and through a first end of a collar body of a corrosion inhibition apparatus;

conveying the corrosive fluid through an opening of a sacrificial anode and a visual indicator positioned at least partially in the collar body;

conveying the corrosive fluid through a second end of the collar body and subsequently through a second conduit coupled to the second end, wherein the first conduit and the second conduit form a part of a system;

applying pressure against the visual indicator and the sacrificial anode such that the sacrificial anode remains in contact with at least a portion of the corrosion inhibition apparatus using an elastically compressed member;

providing a visual signal of an extent of a dissolution of the sacrificial anode using the visual indicator; and inhibiting corrosion of at least a portion of the system using the sacrificial anode.

18. The method of claim 17, wherein the visual indicator is visible through the collar body as the sacrificial anode dissolves.

19. The method of claim 17, wherein the flow of electrolytic fluid against the visual indicator compounds the force of the elastically compressed member insuring metallic contact between the sacrificial anode and at least a portion of the corrosion inhibition apparatus.

20. The method of claim 17, further comprising allowing disassembly and replacement of the sacrificial anode without disconnecting either the first and/or second conduit from portions of the corrosion inhibition apparatus.

* * * * *